US005404263A

United States Patent [19]

Graves et al.

[11] Patent Number: 5,404,263

[45] Date of Patent: Apr. 4, 1995

[54] ALL-GLASS HEADER ASSEMBLY USED IN AN INFLATOR SYSTEM

[75] Inventors: Thomas J. Graves, Parker; James A. Longwell, Elizabeth, both of Colo.

[73] Assignee: OEA, Inc., Aurora, Colo.

[21] Appl. No.: 32,836

[22] Filed: Mar. 10, 1993

Related U.S. Application Data

[63] Continuation of Ser. No. 937,347, Aug. 27, 1992, abandoned.

[51] Int. Cl.[6] ..... F23Q 3/00

[52] U.S. Cl. ..... 361/247; 102/292.14; 180/282

[58] Field of Search ..... 361/247, 248, 320, 321; 180/282; 280/736, 734, 741; 307/10.1; 29/25.42; 102/202.2, 202.9, 202.11, 202.14

[56] References Cited

U.S. PATENT DOCUMENTS

| | | | |
|---|---|---|---|
| 2,696,191 | 12/1954 | Sheehan | 102/86.5 |
| 3,082,691 | 3/1963 | Evans et al. | 102/28 |
| 3,134,329 | 5/1964 | Zeman | 102/28 |
| 3,223,599 | 12/1965 | Taylor . | |
| 3,291,046 | 12/1966 | Dahl | 102/28 |
| 3,308,758 | 3/1967 | Stadler et al. | 102/28 |
| 3,426,682 | 2/1969 | Corren et al. | 102/28 |
| 3,429,260 | 2/1969 | Corren | 102/28 |
| 3,695,179 | 10/1972 | Ralnone et al. | 102/70.2 R |
| 3,858,392 | 1/1975 | Evans et al. | 60/637 |
| 3,971,320 | 7/1976 | Lee | 102/28 R |
| 3,983,624 | 10/1976 | Gross | 29/628 |
| 4,103,619 | 8/1978 | Fletcher et al. | 102/28 R |
| 4,249,673 | 2/1981 | Katoh et al. | 222/3 |
| 4,267,567 | 5/1981 | Nygaard et al. | 362/46 |
| 4,441,427 | 4/1984 | Barrett | 102/202.6 |
| 4,445,920 | 5/1984 | Smith . | |
| 4,484,523 | 11/1984 | Smith et al. | 102/202.5 |
| 5,076,607 | 12/1991 | Woods et al. | 280/737 |
| 5,113,764 | 5/1992 | Mandigo et al. | 102/202.9 |
| 5,131,679 | 7/1992 | Novak et al. | 280/736 |
| 5,140,906 | 8/1992 | Little, II | 102/202.14 |
| 5,200,574 | 4/1993 | Cunningham et al. | 102/830 |

FOREIGN PATENT DOCUMENTS

| | | |
|---|---|---|
| 0248977 | 2/1987 | European Pat. Off. . |
| 0510551A2 | 4/1992 | European Pat. Off. . |

OTHER PUBLICATIONS

Engineering Drawing Entitled "Initiator Subassembly" dated Feb. 6, 1990.

Engineering Drawing Entitled "Header, Glass Sealed Assembly" dated Dec. 8 1976 by the Dept. of Navy Naval Sea Systems Command.

Engineering Drawing Entitled "Header Assy" date Apr. 17, 1989.

*Primary Examiner*—Jeffrey A. Gaffin

*Attorney, Agent, or Firm*—Sheridan Ross & McIntosh

[57] ABSTRACT

An all-glass header assembly is provided for use in an air bag system that is located in a vehicle. The header assembly acts to initiate flow of gases into the air bag. The header assembly includes an eyelet having a bore that receives an all-glass insulating body that is flush with an outer surface of the eyelet. A center electrode pin is located through a preformed hole in the center of the glass insulating body. A side electrode pin is welded to the eyelet. Electrical current flows through the two electrode pins when predetermined power is applied at a desired time. In making the all-glass header assembly, a fixture system and process are employed for achieving flushness among the eyelet, glass insulating body and center electrode pin while avoiding unwanted voids, bubbles or cracks in the glass insulating body.

24 Claims, 6 Drawing Sheets

ALL-GLASS HEADER ASSEMBLY USED IN AN INFLATOR SYSTEM

This is a continuation of application Ser. No. 07/937,347, filed on Aug. 27, 1992, now abandoned.

FIELD OF THE INVENTION

The present invention relates to an initiator device for use in an air bag system provided in a vehicle and, in particular, to an all-glass header assembly used in connection with inflating an air bag.

BACKGROUND OF THE INVENTION

The use of air bag systems in vehicles has increased significantly in recent years. In conjunction with the activation of the system whereby the bag is inflated, a header assembly commonly acts as an initiator in causing gases to fill the bag.

A known header assembly made by the assignee of the present invention includes an eyelet having a glass insulator and ceramic insert positioned through the center of the eyelet. The glass insulator is hermetically sealed in the eyelet. The ceramic insert has an outer surface that is substantially flush with an end of the eyelet. An epoxy is disposed in the eyelet bore before insertion of the ceramic insert. A center electrode pin is located co-axially relative to the glass insulator and ceramic insert. A side electrode pin is welded to the eyelet. A bridgewire is connected between an end of the center electrode pin and the eyelet with the wire extending over and contacting the ceramic insert. When power is applied, current flows between the center electrode pin and the eyelet, as well as the side electrode pin, through the conducting bridgewire. In operation with an air bag inflator system, the current through the bridgewire activates an ignitor component that ignites a propellant or generates gases for use in filling an air bag.

With respect to this prior art header assembly used in air bag systems, the ceramic insert is intended to provide a substantially smooth, flush surface so that there are no bubbles or cracks that may affect the bridgewire placed across the ceramic insert. That is, the outer surface of the eyelet together with the ends of the ceramic insert and center electrode pin, are made and assembled to be substantially even or flush with each other. In achieving the desired flushness, a grinding process is utilized. With respect to the use of the ceramic insert, both before and after the grinding process, it has been found to be free of bubbles or cracks that may act to degrade the bridgewire, which degradation may result in the bridgewire breaking. Although the ceramic insert achieves the desired result of a bubble or void-free outer end or surface, this header assembly does have the additional parts of a ceramic insert and epoxy, which are used with the glass insulator to insulate the center electrode pin.

In connection with military related applications, it is known to use initiator devices or header assemblies for ignition-related purposes. In these known uses, header assemblies have been provided in which the entire insulating body is made of a sealing glass. These known prior art devices have one or more features or characteristics that make them less appropriate for use in a vehicle air bag system. These attributes include eyelets that are not corrosion resistant, an uneven glass outer surface, and a less desirable glass composition.

SUMMARY OF THE INVENTION

In accordance with the present invention, a header assembly is disclosed that includes a cylindrical shaped eyelet having a bore through its center. An insulating glass member is sealed in the bore. The glass member has a center hole that receives a first or center electrode pin. A second or side electrode pin is welded to the eyelet. The eyelet is made of a non-corrosive material such as stainless steel. The glass member has an outer surface or end that is to be substantially flush with a first outer surface of the eyelet. In one embodiment, the distance from the inner diameter to the outer diameter of the eyelet is greater than the diameter of the glass member. The glass member is, in one embodiment, made from drawn glass tubing and has a length substantially equal to the length of the eyelet.

In making the all-glass header assembly of the present invention, the second electrode pin is welded to the eyelet. When inserting the glass member into the eyelet bore, a fixture system is utilized. The eyelet having the second electrode pin is located in a first fixture plate in which upper portions of the eyelet extend beyond a recess formed in the first fixture plate. A slot is formed through the bottom of the recess and extends across the diameter of the recess. The slot has a width sufficient for the second electrode pin to be inserted therethrough. After locating the eyelet and the second electrode pin in the first fixture plate, the glass member is inserted in the eyelet bore. Because the diameter of the glass member is greater than the width of the slot, the glass member is unable to pass through the bore, but is supported by the fixture plate material at the bottom of the recess. After insertion, the glass member is at least flush with the first outer surface of the eyelet, but may extend a short distance outwardly of the eyelet. After the glass member has been inserted, the second fixture plate having a plurality of cavities is positioned over the first fixture plate so that the upper portions of the eyelet are received by one of the cavities. The two fixture plates are then inverted. The first fixture plate also has an aperture aligned with each recess. The first electrode pin is inserted through the aperture and the slot into the glass member center hole so that it is coaxial with the eyelet.

After assembly of each glass header using the fixture system, the first and second fixture plates, together with the glass header assemblies located therein, are subjected to a heating process whereby a compression glass seal is achieved by the glass member in the eyelet. That is, the metal eyelet has a different thermal expansion coefficient from that of the glass member. The eyelet, after being subjected to heat for a predetermined time and temperature, contracts relatively more greatly than the glass member whereby the glass member is subject to compression so that a desired hermetic seal results. After the heating process, the glass headers are subject to a process for achieving the substantial smooth and flush outer surfaces and ends among the eyelet, glass member and first electrode pin. Preferably, this process involves use of an alumina oxide wheel that grinds these outer surfaces and ends to within a predetermined flushness. The resulting glass member in the header assembly is flush to or above the eyelet upon completion of these process finishing steps including the surface grinding.

In conjunction with preparing each glass header for use in the air bag system, a bridgewire is attached between the first outer surface of the eyelet and the end of the first electrode pin that is substantially flush with the eyelet first outer surface. In one embodiment, the diameter of the bridgewire is about 0.0015 inch. The glass member must not have a void, bubble or crack that has a diameter greater than the diameter of the bridgewire. Consequently, for a bridgewire diameter of 0.0015 inch, the maximum allowable void, bubble or crack is 0.0015 inch in diameter. This requirement is intended to avoid a break in the bridgewire due to a surface void, bubble or crack. The bridgewire provides a conductive path between the first and second electrode pins while the first electrode pin is electrically insulated from the second electrode pin by means of the glass member. An ignitor material is located relative to the bridgewire such that it is heated when current flows between the first and second electrode pins through the bridgewire. When the ignitor material is heated, it ignites and, in turn, causes a propellant to ignite. The activated propellant is used in generating gases for filling an air bag at a desired rate.

Based on the foregoing summary, a number of important features of the present invention are readily discerned. An all-glass header assembly is provided that achieves the required insulation between first and second electrode pins. Because the insulating material is all glass, instead of including a ceramic insert, fewer components are required thereby reducing the cost of the header assembly. Assembly of the all-glass header requires less time because no epoxy and no ceramic insert is required. Furthermore, a somewhat less expensive grinding wheel can be employed in comparison with the grinding wheel utilized in providing a smooth surface in a header assembly that has a ceramic insert.

Additional advantages of the present invention will become readily apparent from the following discussion, particularly when taken together with the accompanying drawings.

DETAILED DESCRIPTION

Figure 1:
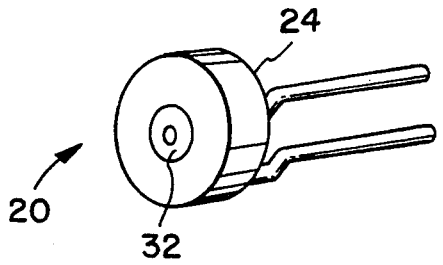
FIG. 1 is a perspective view of the all-glass header assembly of the present invention.
Figure 2:
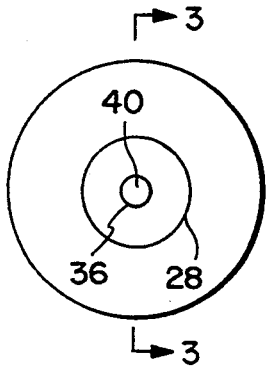
FIG. 2 is a top view of the header assembly.
Figure 3:
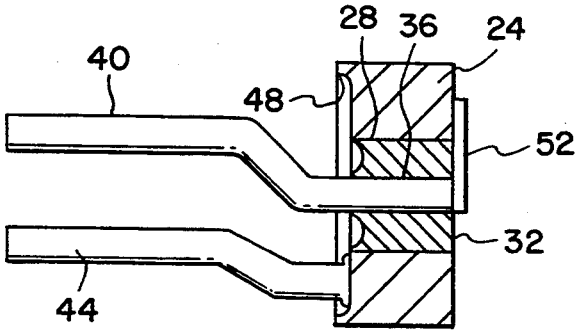
FIG. 3 is a longitudinal cross-sectional view, taken along lines 3—3 of FIG. 2, illustrating the glass member positioned in the bore of the eyelet and the first electrode pin located through the center hole of the glass member, as well as the bridgewire electrically connecting the first electrode pin and the eyelet.

An all-glass header assembly for use with an air bag system is disclosed. Referring to FIGS. 1–4, the header assembly 20 includes a cylindrical eyelet 24 that includes a center bore 28. The eyelet 24 is made of a non-corrosive material so that oxidation of the eyelet 24 does not occur. In a preferred embodiment, the eyelet 24 is made of stainless steel designated using the industry standard 304L. The bore 28 is located entirely through the eyelet center. In one embodiment, the diameter of the eyelet 24 is about 0.289 inch and its length or height is about 0.138 inch. A glass insulating body or member 32 is disposed within the center bore 28. The length or height of the glass member 32 is substantially equal to the length of the eyelet 24 and occupies substantially all of the space defined by the bore 28, but with the glass member 32 having a center hole 36 for receiving a center or first electrode pin 40. The glass member 32 is a compression sealing glass, preferably, sodasilicate glass. In one embodiment, the glass member 32 is made of drawn glass tubing of a size to be received by the bore 28. As illustrated in FIG. 3, the eyelet 24 is definable as having a first outer surface that, together with adjacent ends of the glass member 32 and first electrode pin 40, are found in the same plane, wherein these ends and surface are substantially flush or co-planar. This substantial flushness is critical to the header assembly 20, as will be explained later in greater detail.

Figure 4:
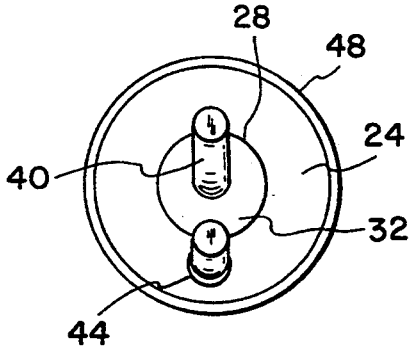
FIG. 4 is a perspective bottom view of the header assembly.

The first electrode pin 40 extends in the opposite direction beyond the eyelet 24 and terminates after a predetermined or desired distance. Electrical power can be applied to the first electrode pin 40 and electrical current is conducted through the electrode pin 40. A second or side electrode pin 44 is connected, in non-coaxial relation, to the eyelet 24. In a preferred embodiment, the second electrode pin 44 is welded to the eyelet 24 and terminates at a distance from the eyelet 24 substantially equal to that of the first electrode pin 40. The second electrode pin 44 is commonly used as a ground or return pin for completing an electrical circuit or path between the first and second electrode pins 40, 44. As can be seen in FIGS. 3 and 4, the second electrode pin 44 is welded to the eyelet 24 within a rim 48 that extends about the circumference of the eyelet 24. In one embodiment, the first electrode pin 40 is made of 52 alloy metal and the second electrode pin 44 is made of the same material as the eyelet 24.

In order to complete the conductive path between the electrode pins 40, 44, a bridgewire 52 is held between portions of the eyelet 24 and the first electrode pin 40. The bridgewire 52 extends over and contacts portions of the electrically insulating all-glass member 32. The bridgewire 52 is electrically conductive and electrically interconnects the first and second electrode pins 40, 44 through the eyelet 24. Referring to the extreme smoothness or flushness desired, if there were a crack, bubble or void in the glass member 32 outer surface of sufficient size, it could cause a degradation in the bridgewire 52 where the bridgewire 52 extends over such a crack, void or bubble. Such a degradation could constitute a break in the bridgewire 52 so that the electrical conductive path between the first and second electrode pins 40, 44 is lost or unacceptably diminished. To avoid such degradation, the maximum allowable void or bubble cannot be greater than the diameter of the bridgewire 52. In one embodiment, the bridgewire is 0.0015 inch in diameter and the maximum allowable void, bubble or crack is 0.0015 inch in diameter.

Figure 5:
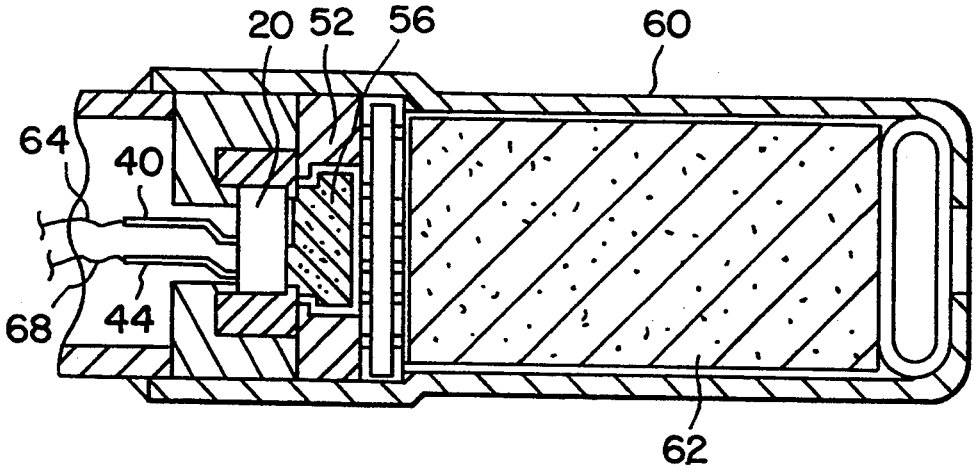
FIG. 5 illustrates a schematic representation of the header assembly used in an air bag system.

Referring now to FIG. 5, the header assembly 20 is incorporated with an air bag inflator system useful in inflating an air bag located in a vehicle. The header assembly 20 is positioned so that the bridgewire 52 contacts or communicates with an ignitor charge 56 within a housing 60. The first and second electrode pins 40, 44 are connected to conductive wires 64, 68 respectively to provide the conductive path for the electrical current generated by a power source. In that regard, when power is applied, upon the occurrence of one or more predetermined conditions, electrical current flows through the first electrode pin 40 to the second electrode pin 44 through the eyelet 24 and, in so doing, current flows through the bridgewire 52 causing it to be heated to a sufficient temperature whereby the ignitor charge 56 is activated. The activation of the ignitor charge 56, in turn, activates or energizes propellant 72 also contained within the housing 60. The ignition of the propellant 72 is useful in generating gases associated with the filling of the air bag with gases.

Figure 6:
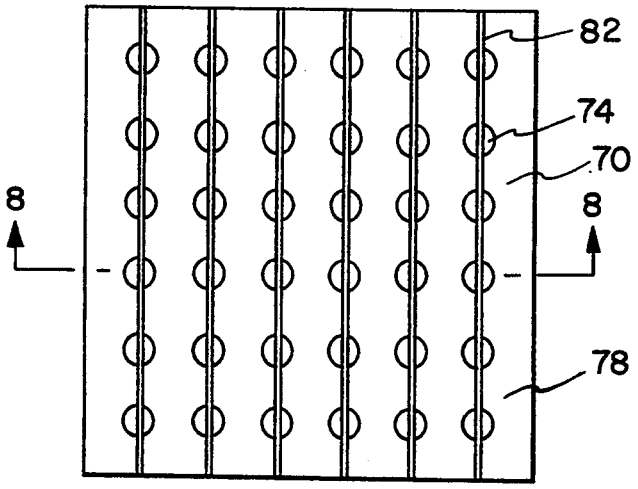
FIG. 6 is a top view of a first fixture plate used in holding a number of eyelets with second electrode pins in order to receive the insulating glass member.
Figure 7:
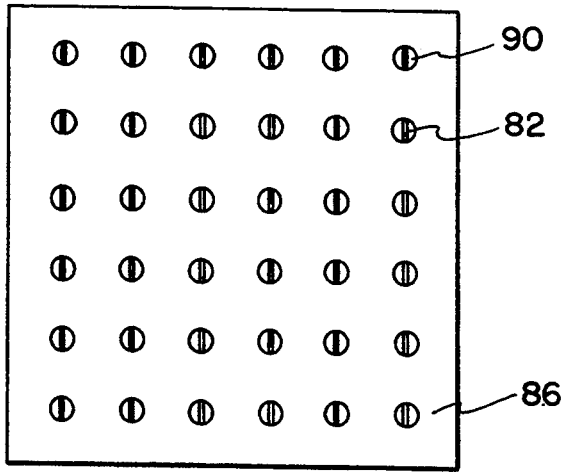
FIG. 7 is a bottom view of the first fixture plate illustrating the slots through the bottom of the recesses and the apertures that communicate with the recesses by means of the slots.
Figure 8:
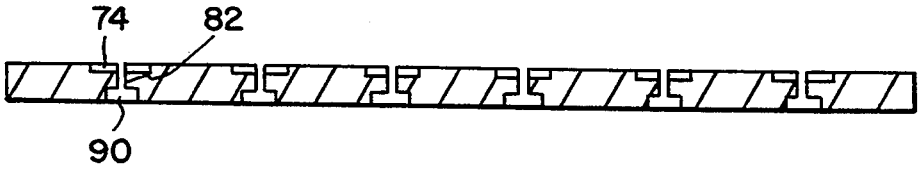
FIG. 8 is a lateral cross-sectional view, taken along lines 8—8 of FIG. 6, illustrating the communication among the recesses, slots and apertures.
Figure 9:
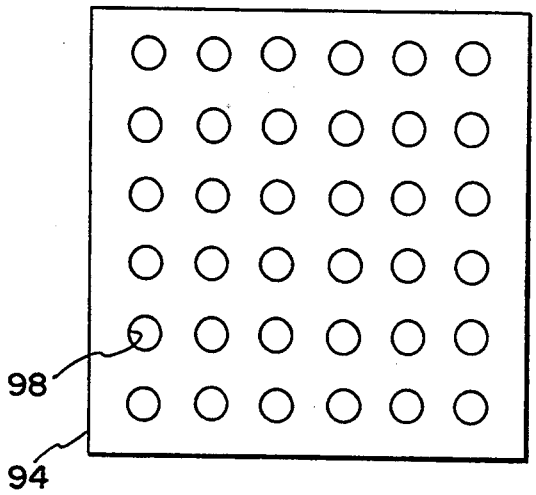
FIG. 9 is a top view of a spacer plate useful in receiving the second electrode pin.

Reference is now made to FIGS. 6–11 to describe one embodiment for use in assembling the parts of the header assembly 20. A first fixture plate 70 is illustrated in FIGS. 6–8. The first fixture plate 70 is substantially square and has a plurality of recesses 74 formed in a front face 78 thereof. The recesses 74 are uniformly formed and spaced from each other with the bottoms of the recesses 74 located somewhat less than halfway through the thickness of the first fixture plate 70, as illustrated in FIG. 8. Slots 82 are formed through the recesses 74 and extend across the recesses 74 and beyond so that, for each column of recesses 74, a slot 82 is formed between the edges of the first fixture plate 70. A back face 86 of the first fixture plate 70 is illustrated in FIG. 7 and has a number of apertures 90 formed in alignment with the recesses 74. The apertures 90 also extend into the thickness of the first fixture plate 70 for a distance somewhat less than one-half the thickness thereof. The diameters of the apertures 90 are less than the diameters of the recesses 74. The slots 82 provide communication between each of the recesses 74 and the apertures 90 whereby a through opening is provided between the front and back faces 78, 86 of the first fixture plate 70.

The fixture system of this embodiment also includes a spacer plate 94 having a number of openings 98. The spacer plate 94 has substantially the same length and width as that of the first fixture plate 70. There are the same number of openings 98 as there are recesses 74 and cavities 90. The diameters of the holes 98 are substantially the same as the diameters of the recesses 74. The spacer plate 94 acts to raise or space the first fixture plate 70 from a support surface. That is, as will be explained later, the spacer plate 94 is located on a support surface and the first fixture plate 70 is placed on top of and supported by the spacer plate 94. The second electrode pin 44 has a length greater than the thickness of the first fixture plate 70. When the second electrode pin 44 is received by the first fixture plate 70, it passes through one of the openings 98 in the spacer plate 94 so that the second electrode pin 44 is not blocked or impeded by a support surface on which the first fixture plate 70 and the spacer plate 94 are placed.

Figure 10:
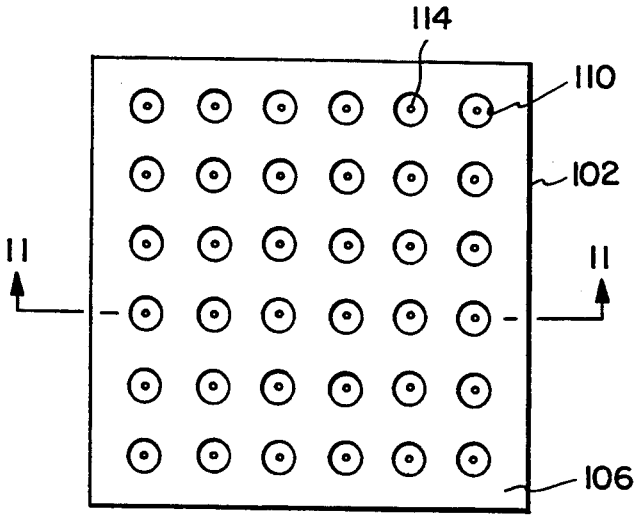
FIG. 10 is a top view of a second fixture plate illustrating cavities for receiving upper portions of the eyelets.
Figure 11:
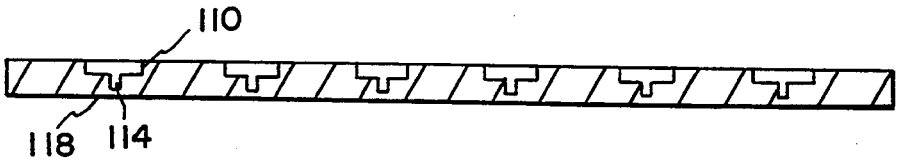
FIG. 11 is a lateral cross-sectional view, taken along lines 11—11 of FIG. 10, illustrating the depth of the cavities.

Referring to FIGS. 10 and 11, the fixture system of this embodiment further includes a second fixture plate 102. The second fixture plate 102 has a front face 106 and a number of cavities 110 formed through the front face 106 and into the thickness of the second fixture plate 102 for a distance less than about one-half the thickness thereof. For each cavity 110, a pin receiver 104 extends beyond the bottom of the cavity 100 into the thickness of the second fixture plate 102 and terminates before reaching a back face 118 of the second fixture plate 102. Each of the cavities 110, like the recesses 74, has a diameter substantially equal to the diameter of the eyelet 24 of the header assembly 20. The pin receiver 104 is used to receive any portion or length of the center electrode pin 40 that extends beyond the first outer surface of the eyelet 24. It is not uncommon for the center electrode pin 40 not to be flush with the eyelet 24 and the glass member 32 when placed into the first and second fixture plates 70, 102, as will be noted subsequently during the discussion of the assembly of a header assembly 20 using the first and second fixture plates 70, 102 and the spacer plate 94.

Figure 12A:
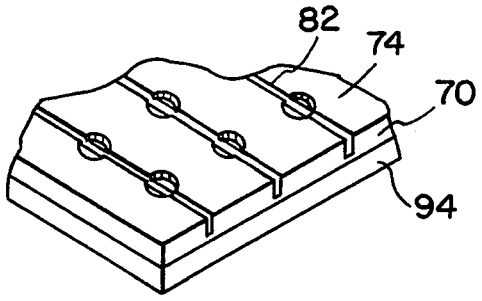
FIGS. 12*a*–12*g* illustrate steps taken in assembling the all-glass header of the present invention.
Figure 12B:
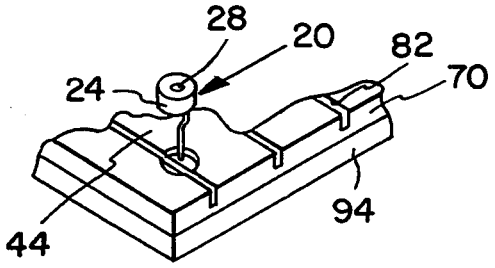
Figure 12C:
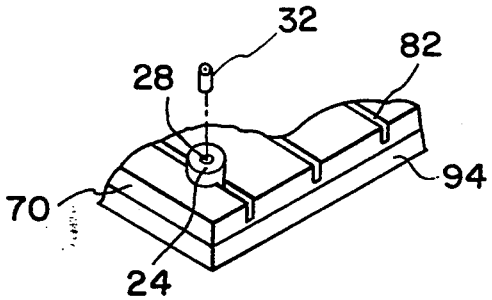
Figure 12D:
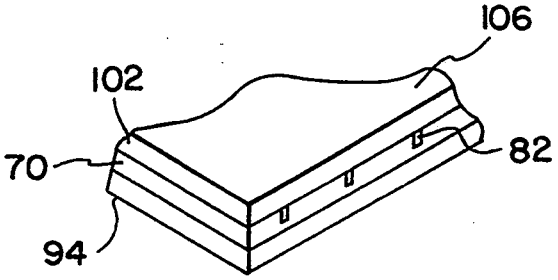

Regarding assembly of a header 20 using the fixture system of this embodiment, reference is made to FIGS. **12*a*–12*g*. As illustrated in FIG. 12*a*, the bottom face 86 of the first fixture plate 70 is placed on top of the spacer plate 94. In so doing, the edges of the first fixture plate 70 and spacer plate 94 are aligned whereby the recesses 74 of the first fixture plate 70 are aligned with the openings 98 of the spacer plate 94. A communication path is thereby established between the recesses 74 and the openings 98 through the slots 82 and the apertures 90. In this alignment, as illustrated in FIG. 12*b*, the combination of the eyelet 24 and the second electrode pin 44 welded thereto can be inserted into one of the recesses 74. That is, the second electrode pin 44 passes through a slot 82 into its associated aperture 80 and an aligned opening 98 formed in the spacer plate 94. Because of the length of the second electrode pin 44, portions thereof are received by the opening 98 and the spacer plate 94 acts to prevent the second electrode pin 44 from contacting the support surface on which the spacer plate 94 is located. After the eyelet 24 and its accompanying side electrode pin 44 are received by the first fixture plate 70 of a spacer element 94, as seen in FIG. 12*c*, substantial upper portions of the eyelet 24 extend beyond the front face 78 of the first fixture plate 70. In this position, the glass member 32 is placed into the bore 28 of the eyelet 24. This step can be accomplished manually by using tweezers or some other holding member that grasps the glass member 32 and then is manipulated to insert the glass member 32 into the bore 28**.

Figure 12E:
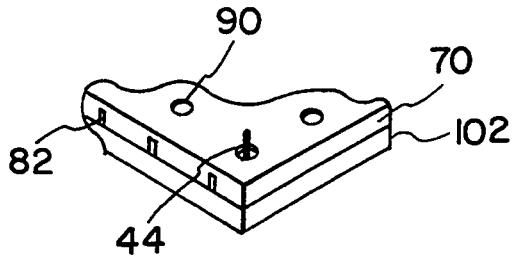
Figure 12F:
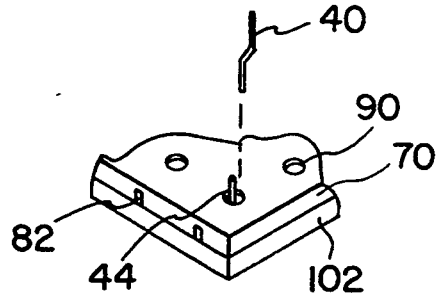

After the glass member 32 has been inserted, the second fixture plate 102 is aligned on top of the first fixture plate 70, as illustrated in FIG. **12*d*. During this step, each cavity 110 receives upper portions of the eyelet 24 that extend beyond each recess 74. That is, each cavity 110 matingly receives such portions of the eyelet 24 while edges of the first and second fixture plates 70, 102 and the spacer plate 94 are substantially aligned or flush with each other. After the second fixture plate 102 has been placed over the first fixture plate 70, the fixture system or this combination of plates are inverted or turned over so that the second fixture plate 102** is located on the support or table surface. As indicated by FIG. 12*e*, the spacer plate 94, which had been the upper member after the inversion, has been removed whereby the second or side electrode pin 44 is exposed and can be seen as extending beyond the back face 86 of the first fixture plate 70. In this configuration, the center or first electrode pin 40 can now be inserted into the center hole 36 formed in the glass member 32. In particular, the center electrode pin 40 first passes through the aperture 90, then the slot 82 and then the recess 74 formed in the first fixture plate 70 for subsequent entry into the center hole 36 formed in the glass member 32. Because of the pin receiver 104 formed in the second fixture plate 92, the center electrode pin 40 is able to extend outwardly of the glass member 32, if necessary.

Figure 12G:
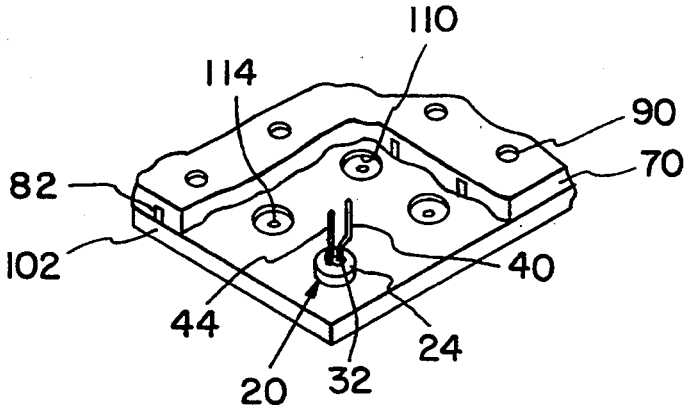

As seen in FIG. 12*g*, an assembled header assembly 20 is illustrated for subsequent processing in order to provide the finished product. Regarding such processing steps, the first and second fixture plates 70, 102 are placed into a heating unit or furnace in order to fuse the glass and thereby achieve a hermetic seal. The fixtures, together with the header assemblies, are maintained in the heating unit for a predetermined time at a predetermined temperature, which are substantially the same time and temperature involved in fusing the glass in the prior art header assembly that includes a ceramic insert and epoxy. Because the eyelet 24 is made of a metal that contracts more rapidly than the glass member 32, the glass member 32 is compressed during the heating step and a hermetic seal is achievable. A hermetic seal of $2.7\times10^{-7}$ SPD cc/sec of Helium is achieved after certain pre-defined testing. Additionally, after the glass is compressed after and as a result of the heating step, the first outer surface of the glass member 32 is above the eyelet 24 or flush therewith with the glass member 32 extending no more than about 0.015 of an inch above the eyelet 24. As seen in FIG. 3, a glass seal meniscus is also formed adjacent the bottom of the center bore 28 formed in the eyelet 24. The bottom of the meniscus is substantially flush with the bottom outer surface of the eyelet 24.

After the heating and associated fusings steps, further processing involves obtaining or insuring substantial smoothness or flushness among the first outer surface of the eyelet 24, and the adjacent ends of the glass member 32 and the center electrode pin 40. As previously indicated, the center electrode pin 40 may extend outwardly beyond the first outer surface of the eyelet 24. In order to make this terminating end of the center electrode pin 40 flush, the processing steps include removal of center electrode pin material, as well as possibly first outer surface material of the eyelet 24 and the end of the glass member 32 adjacent this first outer surface. The removal of such material(s) is accomplished using a grinding mechanism or wheel. In the preferred embodiment, the grinding wheel is made of an alumina oxide material. When the ceramic insert of the prior art header assembly was ground, typically a silicon carbide wheel was utilized. Such material is slightly more expensive and the process of grinding becomes more costly as such wheels need to be replaced or refurbished after a certain amount of usage. After the grinding operation, the glass member 32 is substantially flush with the first outer surface of the eyelet 24 or above the eyelet 24 and preferably no greater than about a few ten thousandths of an inch about the eyelet. Accordingly, the first outer surface of the eyelet 24 and the associated ends of the center electrode pin 40 and the glass member 32 are substantially co-planar.

After the grinding or smoothing operation is completed, the header assembly 20 is cleaned and prepared for subsequent incorporation into an air bag system. As previously noted, such preparation involves attachment or welding of the bridgewire 52 between the eyelet 24 and the center electrode pin 40. Before a header assembly 20 is acceptable for use with an air bag system, a check is also made to ensure that a maximum allowable void, bubble or crack in the outer surface of the glass member 32 has not been exceeded. Since patching or other re-working of the glass member 32 is unacceptable in order to meet this requirement, the glass header 20 that has such a void, bubble or crack cannot be used. Once the bridgewire 52 is fixedly held in place, final steps can be taken to incorporate the header assembly 20, with accompanying bridgewire 52, into the air bag system as schematically illustrated in FIG. 5.

In view of this detailed description, a number of significant advantages of this invention are seen. An all-glass header assembly for use in an air bag system is provided that is characterized by the elimination of a ceramic insert and epoxy used in holding the insert in place in the bore of an eyelet. Because of this, fewer parts are required. Consequently, less expense is involved in making and assembling the all-glass header assembly. Furthermore, in achieving the substantial flushness, a less costly grinding mechanism can be employed and it has been determined that the glass utilized in the present invention can be ground without generating voids, bubbles or cracks that would render the header assembly unacceptable.

The foregoing description of the invention has been presented for purposes of illustration and description. Further, the description is not intended to limit the invention to the form disclosed herein. Consequently, variations and modifications commensurate with the above teachings and the skill or knowledge of the relevant art are within the scope of the present invention. By way of example only, the first electrode pin 40 could be offset from center or eccentrically located relative to the eyelet 24, instead of being co-axial. The preferred embodiment described hereinabove is further intended to explain the best mode known of practicing the invention and to enable others skilled in the art to utilize the invention and with various modifications required by the use of the invention in an air bag system. It is intended that the appended claims be construed to include alternative embodiments to the extent permitted by the prior art.

What is claimed is:

1. A header assembly used in a vehicle air bag system in which the header assembly is used to ignite a ignitor charge by application of electrical current through a bridgewire having a diameter, comprising:

an electrical conductive eyelet having a bore and being made of a non-corrosive material, said eyelet having a first outer surface and a second outer surface;

an insulating body being made of a glass material, wherein said glass insulating body is disposed within said bore and said glass insulating body is substantially coplanar with said first outer surface of said eyelet; and electrode pin means including at least a first electrode pin located in said insulating body, said first electrode pin being electrically insulated from said eyelet using said insulating body, said first electrode pin having a terminating end that it is substantially coplanar with said insulating body and said eyelet.

2. An assembly, as claimed in claim 1, wherein:
said insulating body is a single integral piece and is the only insulating material disposed in all of said bore.

3. An assembly, as claimed in claim 1, wherein:
said eyelet has an inner diameter and the only material contiguously adjacent to said inner diameter of said eyelet is an outer diameter of said glass insulating body.

4. An assembly, as claimed in claim 1, wherein:
said glass insulating body is hermetically sealed to said eyelet.

5. An assembly, as claimed in claim 1, wherein:
said glass insulating body is made substantially of one of the following: compression sealing glass, soda lime, potash soda barium and sodasilicate and said eyelet is made of stainless steel.

6. An assembly, as claimed in claim 1, wherein:
said first electrode pin is disposed substantially coaxial relative to said eyelet.

7. An assembly, as claimed in claim 6, wherein:
said electrode pin means includes a second electrode pin connected to said eyelet.

8. An assembly, as claimed in claim 1, wherein:
said glass insulating body has an end adjacent to said first outer surface of said eyelet with said end of said glass insulating body having no voids greater than a void having a predetermined diameter.

9. An assembly, as claimed in claim 8, wherein:
said diameter of said predetermined void is no greater than a diameter of the bridgewire connected between said eyelet and said first electrode pin.

10. A method for making an all-glass header assembly, comprising:
providing at least a first eyelet having a bore;
inserting an insulating body having a center hole and being made substantially of all glass into said bore;
locating said glass insulating body substantially adjacent to a first outer surface of said eyelet;
positioning a first electrode pin through said center hole in said glass insulating body; and
processing said glass header assembly to achieve a sealed glass insulating body in said eyelet and substantial flushness among said eyelet, said glass insulating body and said first electrode pin at said first outer surface of said eyelet.

11. A method, as claimed in claim 10, wherein: said step of processing includes sealing said glass insulating body in said eyelet after all parts have been inserted in said eyelet bore.

12. A method, as claimed in claim 10, wherein:
said step of processing includes heating to fuse said glass insulating body in said bore after all of said bore has been substantially filled with said glass insulating body.

13. A method, as claimed in claim 10, wherein:
said step of locating includes having said glass insulating body flush to or above said eyelet.

14. A method, as claimed in claim 13, wherein:
said step of heating includes having said glass insulating body at least flush to said first outer surface of said eyelet but being no greater than about 0.015 inch above said first outer surface of said eyelet after completion of said heating step.

15. A method, as claimed in claim 10, wherein:
said step of processing includes grinding at least one of said first outer surface of said eyelet and an end of said glass insulating body and said first electrode pin adjacent to said first outer surface using grinding means made of alumina oxide.

16. A method, as claimed in claim 10, wherein:
said first electrode pin is positioned substantially coaxial relative to said eyelet.

17. A method, as claimed in claim 16, wherein:
said step of providing said eyelet includes joining a second electrode pin to said eyelet.

18. A method, as claimed in claim 10, further including:
incorporating said all-glass header assembly into an air bag system for use in a vehicle.

19. A method, as claimed in claim 10, wherein:
said step of inserting includes providing a first fixture plate having at least a first recess.

20. A method, as claimed in claim 19, wherein: said step of providing said eyelet includes joining a second electrode pin to said eyelet and inserting said second electrode pin through said first recess and into a slot formed adjacent to said first recess with said first outer surface of said eyelet being located outwardly of said first recess and a second outer surface of said eyelet being disposed in said first recess.

21. A method, as claimed in claim 20, wherein:
said step of inserting includes causing said glass insulating body to first enter said bore adjacent to said first outer surface of said eyelet.

22. A method, as claimed in claim 20, wherein:
said step of providing said eyelet includes providing spacer means for spacing said first fixture plate above a support surface whereby said second electrode pin is able to pass from said first fixture plate to an opening formed in said spacer means.

23. A method, as claimed in claim 20, wherein:
said step of positioning said first electrode pin includes providing a second fixture plate having at least a first cavity and placing said second fixture plate in contact with said first fixture plate wherein said cavity receives substantial portions of said eyelet.

24. A method, as claimed in claim 23, wherein:
said step of positioning said first electrode pin includes inverting said first and second fixture plates before positioning said first electrode pin through said hole in said glass insulating body.

* * * * *